US006770871B1

(12) United States Patent
Wang et al.

(10) Patent No.: US 6,770,871 B1
(45) Date of Patent: Aug. 3, 2004

(54) TWO-DIMENSIONAL TANDEM MASS SPECTROMETRY

(75) Inventors: Houle Wang, Auburn, CA (US); Kerry D. Nugent, Penn Valley, CA (US)

(73) Assignee: Michrom BioResources, Inc., Auburn, CA (US)

( * ) Notice: Subject to any disclaimer, the term of this patent is extended or adjusted under 35 U.S.C. 154(b) by 1 day.

(21) Appl. No.: 10/159,222

(22) Filed: May 31, 2002

(51) Int. Cl.[7] ..... H01J 49/00
(52) U.S. Cl. ..... 250/281; 250/282; 250/288
(58) Field of Search ..... 250/288, 281, 250/282

(56) References Cited

U.S. PATENT DOCUMENTS

| | | | |
|---|---|---|---|
| 4,472,631 | A | 9/1984 | Enke |
| 4,540,884 | A | 9/1985 | Stafford |
| 4,978,852 | A | 12/1990 | Williams |
| 5,144,127 | A | 9/1992 | Williams |
| 5,175,431 | A | 12/1992 | Eisele |
| 5,283,436 | A | 2/1994 | Wang |
| 5,523,566 | A | 6/1996 | Fuerstenau |
| 5,569,917 | A | 10/1996 | Buttrill |
| 5,753,909 | A | 5/1998 | Park |
| 6,011,259 | A | 1/2000 | Whitehouse |
| 6,114,691 | A | 9/2000 | Cousins |
| 6,207,370 | B1 | 3/2001 | Little |
| 6,211,516 | B1 | 4/2001 | Syage |
| 6,285,027 | B1 | 9/2001 | Chernushevich |
| 6,329,146 | B1 | 12/2001 | Crooke |
| 6,342,393 | B1 | 1/2002 | Hofstadler |
| 6,380,666 | B1 | 4/2002 | Kawato |
| 6,403,952 | B2 | 6/2002 | Whitehouse |
| 6,586,727 | B2 * | 7/2003 | Bateman et al. ..... 250/282 |
| 6,649,909 | B2 * | 11/2003 | Russ et al. ..... 250/288 |

FOREIGN PATENT DOCUMENTS

| | | |
|---|---|---|
| EP | 0 898 297 A2 | 2/1999 |
| WO | WO 97/47025 | 12/1997 |

OTHER PUBLICATIONS

Mark G. Qian and David M. Lubman; A Marriage Made in MS; Analytical Chemistry; Apr. 1, 1995; vol. 67, No. 7; The University of Michigan.

George Stafford, Jr.; Ion Trap Mass Spectrometry: A Personal Perspective; American Society for Mass Spectrometry; Feb./Mar. 2002; pp. 589–596; Elsevier Science Inc.

March, R. E. et al.; Practical Aspects of Ion Trap Mass Spectrometry; pp. 27–61, 84–88; vol. III; CRC Press.

(List continued on next page.)

*Primary Examiner*—John R. Lee
*Assistant Examiner*—Erin-Michael Gill
(74) *Attorney, Agent, or Firm*—Heisler & Associates

(57) ABSTRACT

A tandem mass spectrometer is provided including two mass analyzers with an ion fragmentation device interposed between the two mass analyzers. The first mass analyzer is a non-destructive mass analyzer, such as an ion trap, to initially collect and hold parent ions and sequentially release parent ions of known mass to charge ratio. The released parent ions pass through the fragmentation device, such as a collision cell, where the parent ions are fragmented into daughter ions. These daughter ions then pass on to the second mass analyzer. The second mass analyzer is of a high speed full spectrum type, such as a time of flight analyzer, so that a full spectrum of mass data is provided for the daughter ions, to go with parent ion mass spectrum data from the first mass analyzer.

43 Claims, 10 Drawing Sheets

OTHER PUBLICATIONS

Tanaka, K. et al.; A MALDI–Quadrupole Ion Trap–ToF Mass Spectrometer; Shimadzu Research Laboratory (Europe) Ltd.; U.K.

Goeringer, E.; Tandem Quadrupole/Time–of–Flight Instrument for Mass Spectrometry/Mass Spectrometry; Analytical Chemistry; 1984; pp. 2291–2295; vol. 56; American Chemical Society; Columbus, U.S.

Michael, S. M. et al.; An Ion Trap Storage/Time–of–Flight Mass Spectrometry; Review of Scientific Instruments; Oct. 1, 1992; pp. 4277–4284; No. 0034–6748; American Institute of Physics; New York, U.S.

Wilhelm, U. et al.; Ion Storage Combined with Reflectron Time–of–Flight Mass Spectrometry: Ion Cloud Motions as a Result of Jet–Cooled Molecules; International Journal of Mass Spectrometry and Ion Processes; Feb. 29, 1996; pp. 111–120; vol. 152, No. 2; Elsevier Scientific Publishing Co.; Amsterdam, NL.

Jonscher, K. R. et al.; The Whys and Wherefores of Quadrupole Ion Trap Mass Spectrometry; Sep. 1996; pp. 1–13; University of Washington at Seattle.

Doroshenko, V. M. et al.; A Quadrupole Ion Trap/Time–of–Flight Mass Spectrometer with a Parabolic Reflectron; Journal of Mass Spectrometry; 1998; pp. 305–318; vol. 33; The Johns Hopkins University School of Medicine; Baltimore, MD.

Hanning–Lee, M. A. et al.; Performance Benefits of a Quadrupole Ion Trap, TOFMS (QitTof); Proceedings of the 49th ASMS Conference on Mass Spectrometry and Allied Topics; May 27–31, 2001; Chicago, IL.

Raptakis, E. et al.; Parameters Affecting Mass Resolution in a MALDI Quadrupole Ion Trap Time–of–Flight Mass Spectrometer; Proceedings of the 49th ASMS Conference on Mass Spectrometry and Allied Topics; May 27–31, 2001; Chicago, IL.

Okumura, A. et al.; Orthogonal Trap–TOP Mass Spectrometer (1)—Synchronous Coupling of Trap and TOF; Proceedings of the 51st ASMS Conference on Mass Spectrometry and Allied Topics; Jun. 8–12, 2003; Montreal, Quebec, Canada.

* cited by examiner

TWO-DIMENSIONAL TANDEM MASS SPECTROMETRY

FIELD OF THE INVENTION

The present invention relates to mass spectrometry apparatuses and methods for obtaining data which identify the mass to charge ratio of various parent ions in a sample as well as mass to charge ratio of daughter ions produced by fragmentation of the parent ions in the sample, such as to determine structural information about the parent ions, and to derive other information about relationships between the parent ions and daughter ions. More particularly, this invention relates to mass spectrometry systems which include tandem mass analyzers separated by an ion fragmentation cell to obtain multi-dimensional data about the parent ions and daughter ions of the sample.

BACKGROUND OF THE INVENTION

In simple mass spectrometers (MS), sample ions are formed in an ion source, such as by Electron Impact (EI), or by Atmosphere Pressure Ionization (API). The ions then pass through a mass analyzer, such as a quadrupole or time of flight device (TOF), for detection. The detected ions can be molecular ions (parent ions), fragment ions (daughter ions) of the molecular ions, or fragment ions of other daughter ions.

Quadrupole mass analyzers and magnetic sector mass analyzers, are mass filter type mass analyzers that allow only ions with specific mass/charge ratios (m/z) to pass through. Other ions are discarded during the scan. These type of mass analyzer is not non-destructive. This type of mass analyzer is thus not particularly effective for a full mass scan (also called full spectrum scan) where multiple ions of different m/z in a sample are to be detected and/or measured. Ion trap mass analyzers can trap ions and than analyze them sequentially based on the Fourier Transform Ion Cyclotron Resonance (FT-ICR) m/z. Mass analyzers can obtain similar full spectrum data, but in a different fashion by first measuring all of the ions and then performing a fourier transform analysis to measure the different ions in the sample. Therefore, the duty cycle and effectiveness of these types of non-destructive mass analyzers for full mass scans is higher than for mass filter type instruments. Time of flight mass analyzers sort ions based on flight time from an accelerator region to a detector spaced from the accelerator region. TOF mass analyzers can detect all ions, no matter what their mass to charge ratios are, and so they have very good sensitivity for a full mass scan spectrum.

Ion fragmentation mass spectrometers have been developed, characterized by having two or multiple sequential stages of mass analysis and an intermediate fragmentation region where parent ions from the first stage are fragmented into daughter ions for the second stage. Hence, these are generally termed "tandem" or "MS/MS" instruments. In such tandem mass spectrometers, sample ions are produced in an ion source, and the first stage of mass analysis analyzes selected parent ions of particular mass or m/z with a mass filter type mass analyzer. Then, some of the selected parent ions are fragmented or otherwise caused to dissociate, such as by metastable decomposition, collision induced dissociation (CID), or collisionally activated dissociation (CAD), to produce the daughter ions. Finally, the second stage of mass analysis sorts the daughter ions according to mass or m/z.

There are two styles of instruments in terms of "tandem" mass spectrometers, "tandem in space" and "tandem in time." Tandem in space mass spectrometers, such as triple quadrupoles and quadrupole-time of flight (Q-TOF) devices, have two mass analyzers, one for parent ion selection and one for daughter ion detection and/or measurement. Two mass analyzers are separated by a fragmentation device. Tandem in time instruments, on the other hand, have one mass analyzer that analyses both parent ions and daughter ions, but sequentially in time. Ion trap and FT-ICR are two most common mass spectrometers that have tandem in time MS/MS. The parent ions first are selected in the analyzer cell then fragmented. Often fragmentation takes place inside the analyzer. Then the daughter ions are analyzed in the same cell. Alternatively, it is known to analyze the daughter ions in a downstream analyzer, such as a TOF analyzer.

Several MS/MS scan types are used based on the relationship between the parent ions and the daughter ions. "Daughter scan" is a method that involves a full scan of daughter ions while the parent ion from which the daughter ions originate is pre-selected and fixed. This method is useful if an analyst knows the molecular weight of the parent ion and wants to know structural information about the parent ion. For instance, two distinct parent ions of similar molecular weight, but different structure can be differentiated by what daughter ions they typically fragment into. The data dependent daughter scan is often used when combined with liquid chromatographs (LC-MS/MS). The mass spectrometer automatically selects a parent ion peak based on previous scans and the peak intensity, charge state and other considerations. The mass analyzer then makes a full scan of the daughter ions resulting from fragmentation of the parent ion of interest.

"Parent ion scan," also known as "precursor scan," is a method that has a fixed daughter ion selection for the second analysis stage, while using the first stage to scan all of the pre-fragmentation parent ions in the sample. Only those molecules/compounds in the sample are detected which produce a specific daughter ion when fragmented. If both parent ion selection and daughter ion selection are fixed, an analyst will get selected reaction monitoring (SRM). SRM has the best selectivity, and good signal to noise ratio for quantitation.

"Neutral loss scan" is a method that shows all parent ions that lose a particular mass during fragmentation. The second stage mass analyzer scans the ions together with the first stage mass analyzer but with a certain offset. Neutral loss scans are used for screening experiments where a group of compounds all give the same loss.

Magnetic and electrostatic sector (together referred to as "sector") mass analyzers have relatively slow scan speed, so sector based MS/MS instruments including sector-sector, sector-quadrupole and sector-TOF are normally good for daughter scans which don't need high speed scanning of parent ions in the first stage. Tandem in time instruments select the parent ion first, then fragment and scan the daughter ions later. Normally this type of instrument can only perform full mass scan of the daughter ions.

Time of flight mass analyzers are known to have a number of advantages, including fast scanning rate, higher sensitivity, relatively high resolution and good mass accuracy. Q-TOF is a MS/MS instrument that combines quadrupole and TOF analyzers. It gives very good mass accuracy and sensitivity on full mass daughter scans but only filters a chosen parent ion with other parent ions being lost.

Triple quadrupole mass spectrometers can do all of the above scans. However, since both the first and second stages of mass analysis are of the mass filter type, triple quadrupole systems are generally less effective than ion trap for full scan MS/MS, and less accurate and sensitive than Q-TOF.

To solve modern analytical problems an analyst often needs to use more than one MS/MS scan method. For LC-MS/MS the parent ions duration time is limited because additional peaks elute from the LC device in a specified time period. Normally there is not enough time to do different types of scans in a single LC run. It is also not unusual that several parent ions co-elute at the same time. In many cases, data dependent scans do not have enough time to fully analyze all parent ions. A combined sector and TOF mass spectrometer is described in Enke at al U.S. Pat. No. 4,472,631. In Enke's method, a collision cell is placed before a magnetic sector. A pulsed ion source is also used, so that the flight time of the ion can be measured. The time resolution is used for parent ion information while a spatial resolution from a sector is used to give daughter ion information. By using a digital computer, a partial two dimensional spectrum of the selected parent ion and daughter ions can be reconstructed.

In Enke's invention, two spatial scan methods are described. One uses a fixed slit before the ion detector. Different daughter ion spectrums can be obtained by scanning magnetic field strength on the sector. For this method, only daughter ions with a particular m/z can be detected at a time. Daughter ions with a m/z other than this particular range of m/z will be thrown away. Less than 1% of all possible useful information can be obtained by the Enke device. This device is thus not effective to obtain highly sensitive full scan daughter ion spectrums.

A design using a multi-channel spatial array detector is also described by Enke. With this design, magnetic field strength within the magnetic sector is not scanned during operation. Rather, a micro-channel array, positioned at the focal plane of the magnetic sector, simultaneously detects and individually resolves ion currents from a plurality of ion paths by use of individual micro-channels. The individual outputs of the micro-channel array are connected through amplifiers to individual time array detectors, connected to a digital computer. This method provides much better detection efficiency with a high duty cycle, but the spatial resolution is limited by the number of detector arrays and the size of the instrument. For a high resolution measurement, thousands of detector elements and associated electronics would be needed.

SUMMARY OF THE INVENTION

Parent ions are first separated by a relatively slow, non-destructive scan device, for example, an ion trap. These parent ions are collected within the ion trap and then selectively released into a fragmentation device, such as a collision cell external to the first analyzer. Parent ion information is determined based on the time that individual parent ions are released from the ion trap or other first mass analyzer. The fragmentation devices sequentially fragment the parent ions into daughter ions. Than each daughter ion is analyzed by a fast scan analyzer, for example, a time of flight (TOF) mass analyzer.

In TOF scan, all ions from the same scan are originally from parent ions having the same mass/charge ratio (m/z). In a certain range, all ions will be fragmented and scanned by TOF scans. A complete two-dimensional MS/MS map can be obtained after a single ion trap scan. A full scan MS spectrum can also be reconstructed by plotting total ion counts for each TOF scan.

Different MS/MS scans such as daughter scan, parent scan, neutral loss scan and selected reaction monitoring are all subsets of this complete 2-D MS/MS map.

During the MS/MS scan, unlike ion filter type instruments, no unnecessary ion loss occurs. A multi-pole ion guide with an electric ion gate prior to the ion trap can also act as an ion reservoir during the scan. Therefore, a theoretical 100% efficiency can be achieved.

OBJECTS OF THE INVENTION

Accordingly, a primary object of the present invention is to provide apparatuses and methods for more rapidly, more completely, more flexibly and more efficiently obtaining data of the type obtained by tandem mass spectrometry (MS/MS).

Another object of the present invention is to provide an apparatus and method for rapidly obtaining ion mass data with high sensitivity and a large dynamic range.

Another object of the present invention is to provide a single mass spectrometry instrument that has good versatility and can perform in multiple scan modes.

Another object of the present invention is to provide a method and apparatus for obtaining MS/MS type two dimensional data about parent ions and daughter ions sufficiently rapidly to facilitate combination with a chromatographic apparatus, such that complete multidimensional data can be obtained in real time, during the relatively short duration of a single chromatographic peak.

Another object of the present invention is to provide a method and apparatus that uses a non-destructive mass analyzer for both first and second stage analysis for obtaining complete spectrum MS/MS type data.

Other further objects of the present invention will become apparent from a careful reading of the included drawing figures, the claims and detailed description of the invention.

DESCRIPTION OF THE PREFERRED EMBODIMENT

Figure 1:
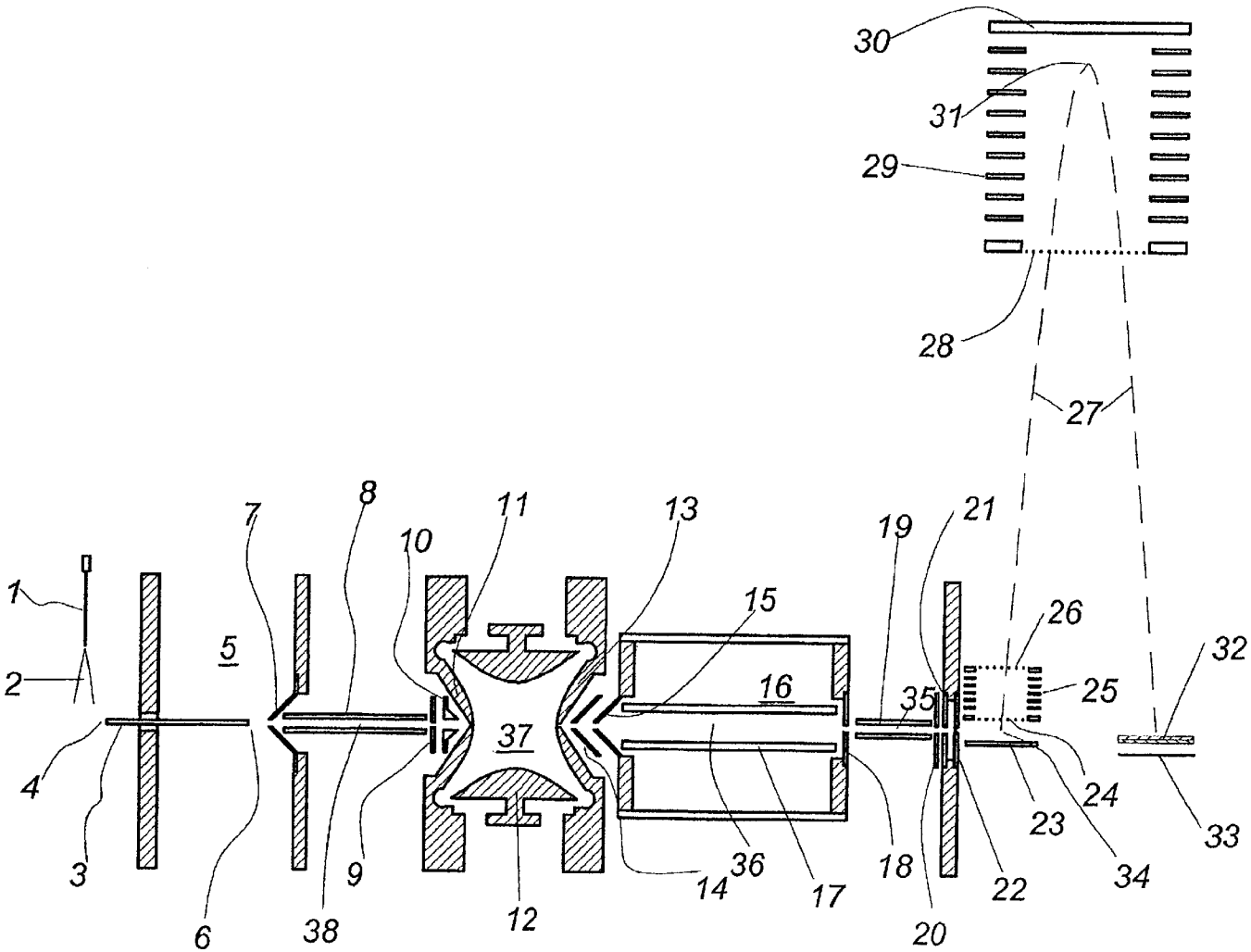
FIG. 1 is a block diagram of a two-dimensional ion trap-TOF tandem mass spectrometer with an external collision cell.
Figure 2:
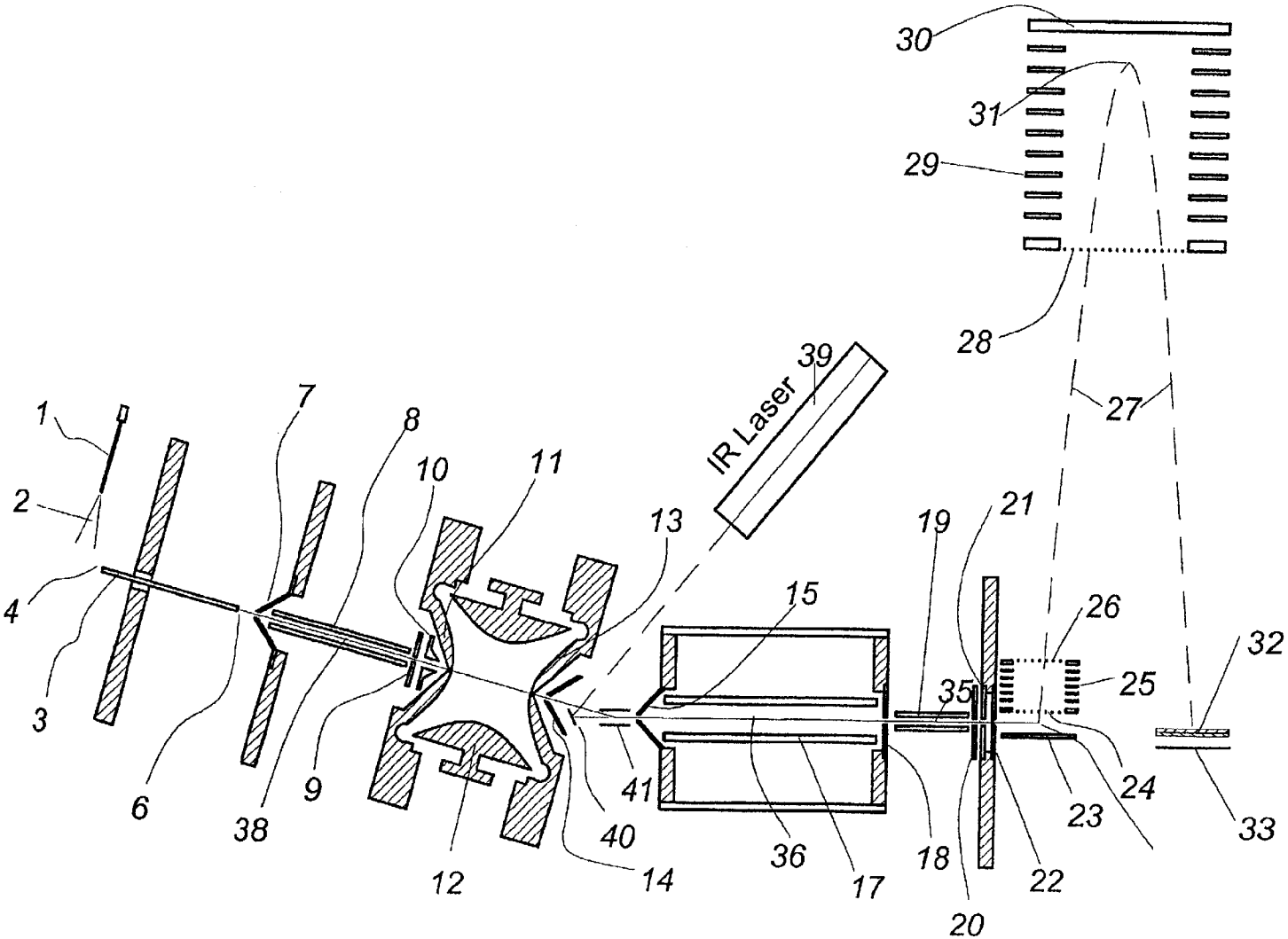
FIG. 2 is a block diagram of two-dimensional ion trap-TOF tandem mass spectrometer with an external infrared multi-photon dissociation (IRMPD) cell.

Referring to the drawings, wherein like reference numerals represent like parts throughout the various drawing figures, FIG. 1 depicts a tandem mass spectrometer featuring an ion trap as a first mass analyzer and a time of flight device as a second mass analyzer according to a preferred embodiment of this invention. The two mass analyzers are separated by a fragmentation cell. In FIG. 2, a variation on the tandem mass spectrometer of FIG. 1 is shown where an infrared laser is included as part of the fragmenter between the two mass analyzers.

In essence, and with particular reference to FIG. 1, a sample is typically first ionized and then fed into an ion guide within a vacuum region leading the ions of the sample into the ion trap or other first stage mass analyzer. The ion trap thus contains one or more species of parent ions therein. As a voltage of the ion trap is increased, ions of different mass/charge ratio (m/z) are sequentially released from the ion trap with such release detected so that a mass/charge ratio for the ions being released is determined. The parent ions released from the ion trap are then passed through a fragmentation cell, where various different fragmentation methodologies can be utilized to divide the parent ions passing therethrough into daughter ions. These daughter ions are then passed on to a second stage mass analyzer preferably in the form of a time of flight (TOF) mass analyzer. The TOF mass analyzer accelerates the daughter ions and then measures an amount of time from ion acceleration until impacting a detector. This time is correlated with the mass/charge ratio of the daughter ions.

Data collection, preferably in the form of a digital computer, is coupled to the ion trap mass analyzer and the TOF mass analyzer so that two dimensional data representative of the mass/charge ratios of both the parent ions and the daughter ions (i.e. FIG. 5), as well as the relative abundance potentially forming a third dimension (FIG. 4), can be plotted a variety of different ways.

More specifically, and with particular reference to FIG. 1, details of the tandem mass spectrometer according to a preferred embodiment of this invention, is described. In FIG. 1 a liquid sample is ionized 2, such as via electrospray, by applying a high voltage between an electron spray ionization (ESI) needle 1 and the end of sample inlet capillary 4. Charged droplets and/or gaseous phase ions pass through the sample capillary 3 and enter into the low vacuum region 5 which is pumped by a roughing pump to about 1 mbar. Most of the air, moisture and neutral solvent molecules are pumped away in this stage. A cone shaped skimmer 7 allow ions through to the next stage. Preferably, a RF only multi-pole ion guide 8 is placed in the next pump region. The pressure in this region is between 0.01 to 0.001 mbar. In such pressure, ions will undergo collisional cooling 38. An electrostatic lens 9, 10 is preferably provided to further focus the ion beam. The above ion source details are typical, but any technique for delivering sample ions to the first stage analyzer of this invention can be similarly utilized.

The ion trap itself can be of either a three dimensional variety or configured as a linear ion trap. Preferably, the ion trap is of the three dimensional type and includes two end cap electrodes 11, 13 and a ring electrode 12 which together form an electric field to trap the parent ion therein. Ions pass through an ion trap inlet, typically in the form of a hole in the end cap electrode 11 and are first trapped in center region 37. These parent ions in the sample are then sequentially released through an ion trap outlet, typically in the form of an exit hole in end cap 13, based on their mass charge ratio m/z. Before the parent ions enter an entrance of the collision cell 16, the kinetic energy of the parent ions from the ion trap is controlled by electrodes 13 and 14.

Collision cell 16 can be any of a variety of means to fragment parent ions into daughter ions. Preferably, the fragmentation cell used keeps the ions contained along a path leading to the second stage analyzer, typically a TOF analyzer, downstream. As shown, the collision cell 16 typically has a RF only multi-pole 17 therein. Ions are thus focused in center region 36 and make collision with Argon or other collision gas in the cell. This process, providing one non-exclusive form of ion fragmenter is referred to as a collision induced dissociation (CID) device. The daughter ions passing out of the fragmenter through an exit (also called fragment ions or product ions) are then typically focused and cooled by another RF only multi-pole ion guide 19 and preferably pass through an electrostatic lens and ion gate assembly 20, 21, 22 before entering in input into the second stage mass analyzer, preferably in the form of a time of flight (TOF) device.

In the TOF device, a push pulse (i.e. 300V) is applied on electrode 23. Ions are pushed to the acceleration region 25. The potential different between mash 26 and 24 accelerate ions to high speed. Ions will fly at a constant speed through a field-free drift region 27, and then are reflected by a reflectron, also called an ion mirror 28–30, before finally striking onto a multi channel plate 32 (MCP) or other detector. Ion striking signals are typically detected by an anode 33 located behind the MCP. The pusher pulse of the acceleration region 25, typically 10 Hz to 20 kHz, also triggers a timing reference for a digitizer. Based on time difference between ion arriving signal and reference trigger signal, time of ion flight is recorded digitally into a computer, later to be converted to mass/charge ratio data for that ion. The computer is configured as one form of a means to acquire, organize, store and/or display the data as depicted in FIGS. 4–10.

The TOF mass analyzer beneficially very quickly scans the daughter ions so that the TOF device is ready to scan daughter ions from the next parent ion subsequently entering the collision cell. To keep the overall tandem mass spectrometer functioning properly in real time, the TOF device preferably scans at least one hundred times faster than the first stage mass analyzer, and preferably one thousand times faster. The first stage mass analyzer can be in the form of a slow TOF device with a gate style detector that can pass parent ions to the collision cell before resulting daughter ions are analyzed by a first TOF device, to keep the speed differential between the two mass analyzers sufficient to avoid overlap of daughter ions from different parent ions in the second stage TOF device.

In FIG. 2, infrared multi-photon dissociation (IRMPD) is used to fragment ions. A laser beam from an infrared laser 39 is reflected by a mirror 40 into a RF only multi-pole region. A parent ion beam from the ion trap is deflected by a deflector 41 into the same region. The parent ions are fragmented by IR radiation. Unlike CID, IRMPD does not require certain kinetic energy for parent ions, and does not need collision gas. Otherwise, the tandem mass spectrometer embodiment of FIG. 2 is similar to that of FIG. 1. The fragmenter can similarly be designed to operate on the principals of collisionally activated dissociation or surface induced dissociation, to achieve the dividing of the parent ions into daughter ions.

Figure 3:
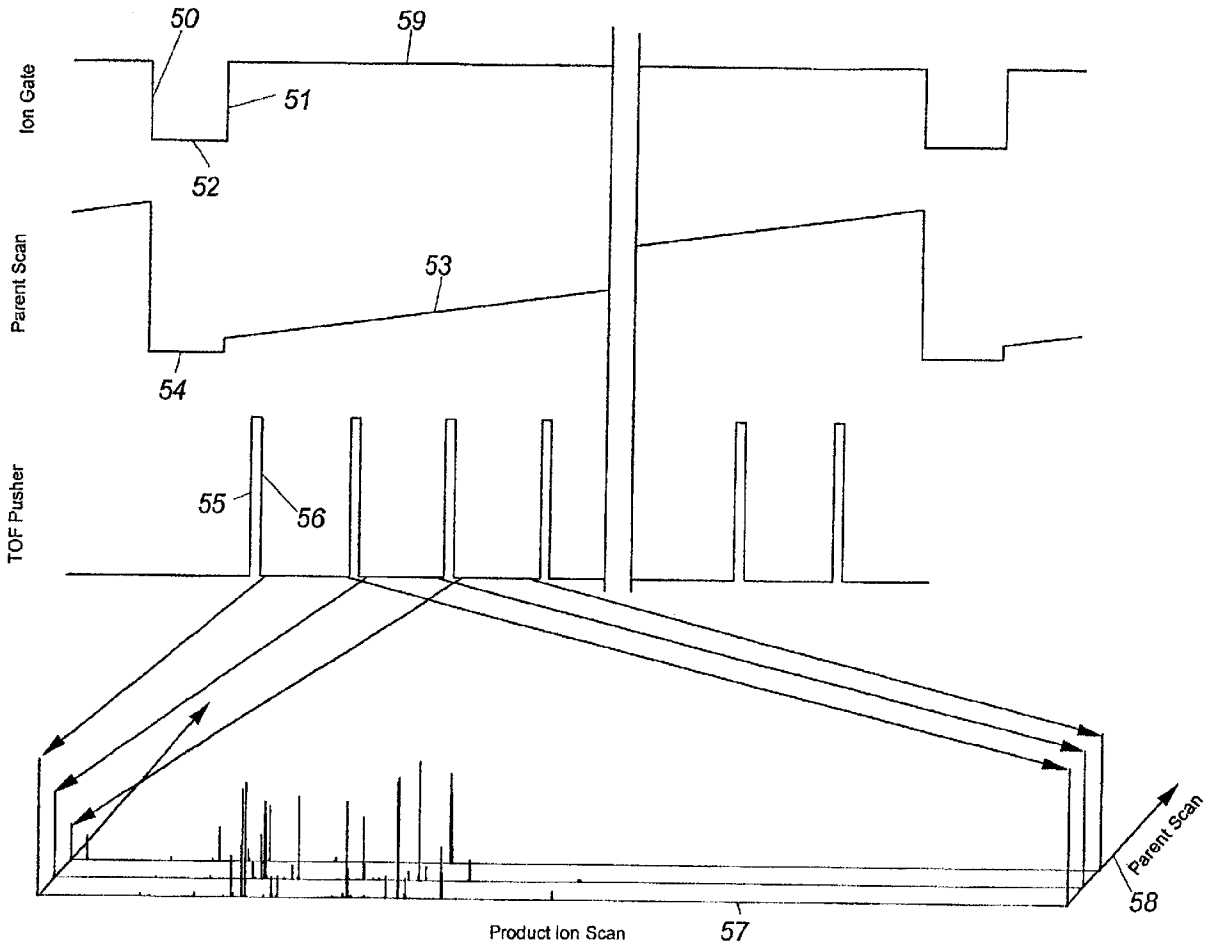
FIG. 3 is a timing diagram that shows the correlation between the first stage analyzer and the second stage analyzer of the tandem mass spectrometer.

FIG. 3 is a timing diagram for the ion trap-TOF tandem MS/MS apparatus of this invention depicting time advance from left to right. Ion gate 9 (FIG. 1) drops the voltage 50 (FIG. 3) to allow ions to enter into the ion trap 37. The ion gate 9 (FIG. 1) will stay open for a short amount of time 52 (i.e. 1–15 milliseconds), then it will close by rising the voltage 51 (FIG. 3). Meanwhile, the ion trap will trap ions 54. During the ion trap scan cycle 53 that follows, the ion gate 9 will remain closed 59. Ions upstream of the ion gate 9 can be accumulated in a multi-pole ion guide with an electric gate if desired, as described above, but are kept out of the ion trap 37. Also, during the ion trap scan cycle 53, voltage pulses 55,56 of typically approximately 300V will be sent to the TOF pusher 23 (FIG. 1) to start the TOF scan.

Each TOF scan represents ions ejected from the ion trap between the last pulse and current pulse, which is a small slice 57 of parent ions. Additional pulses will result in additional slices of parent scans 58 for different parent ion mass/charge ratios. The resolution of such slices will depend on ion trap scan speed and TOF pusher pulse frequency. For example, if trap scan rate is 2000 amu/sec, that will scan from 300–1300 in half a second, and if TOF pusher frequency is 20 kHz, that will give 0.1 amu resolution for parent ions. There will be a few microseconds time delay to allow ions through the collision cell, and also have some velocity variations during this transition, affecting parent ion resolution slightly. If IRMPD fragmentation is used, the daughter ions remain closer together and parent ion resolution is not so affected.

Figure 4:
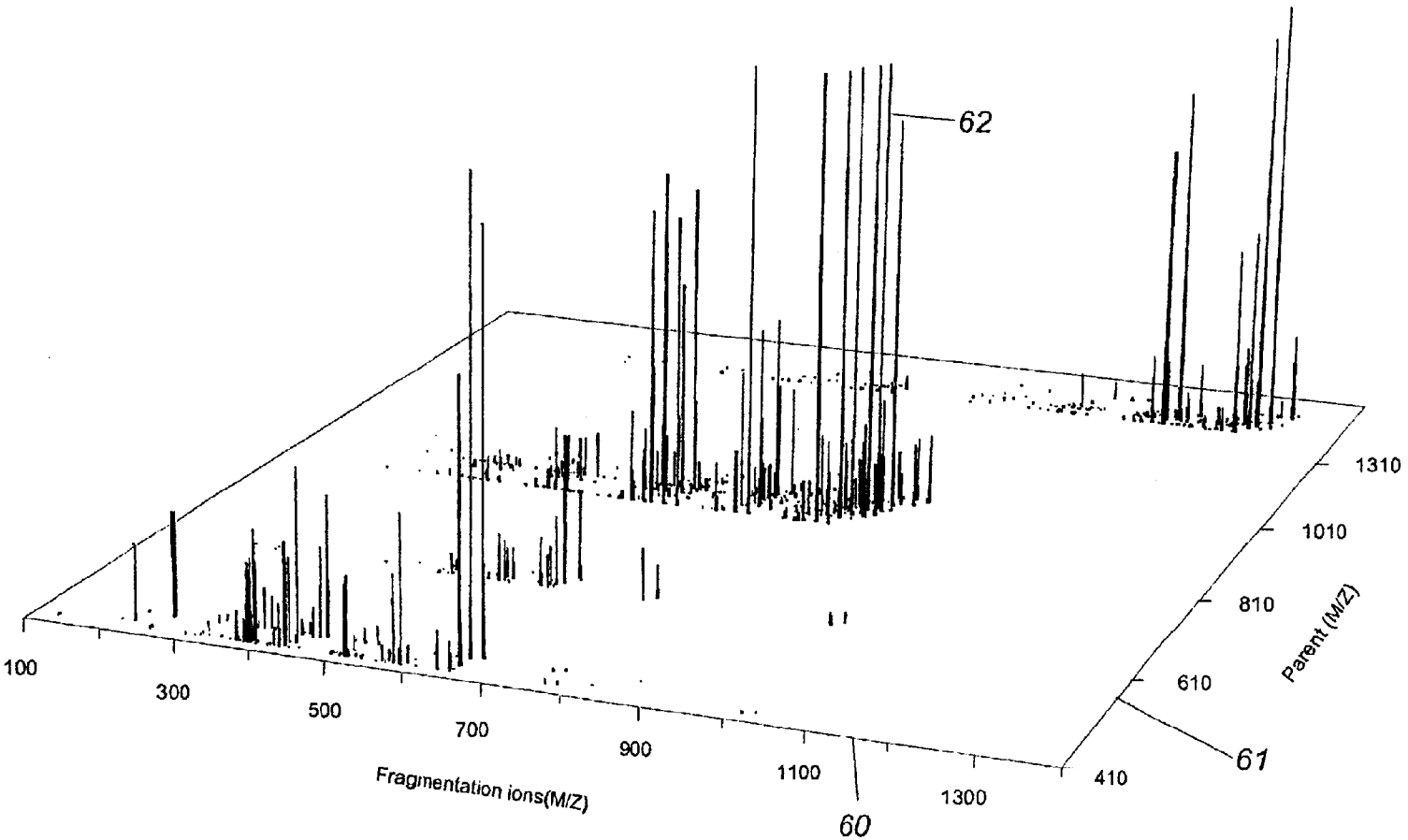
FIG. 4 is a three-dimensional graphical MS/MS map of a mixture of five different angiotensons shown simulating one example of how the MS/MS map of this invention would appear.

FIG. 4 is a three-dimensional fragmentation spectrum of a five angiotensons mixture sample as it would appear if analyzed using the tandem mass spectrometer of this invention. The x-axis 60 represents daughter ion (fragmentation ion) mass to charge ratios and the y-axis 61 represents parent ion mass to charge ratios. The data shown is actually compiled from multiple separate analyses with prior art apparatuses and combined in a fashion depicting how this invention would collect and display data in a single analysis. FIG. 4 graphically illustrates the multi-dimensional information of a complete parent-daughter MS/MS map. The spectrum in FIG. 4 shows five peptides with different adducts, also charge states are from one to three. This spectrum represents the complexity with which multiple compounds may co-elute from a single HPLC peak. It only takes a few seconds by this invention to get a complete 2-D spectrum as shown. In contrast, hours of extensive scanning would be required with prior art tandem mass spectrometry.

Figure 5:
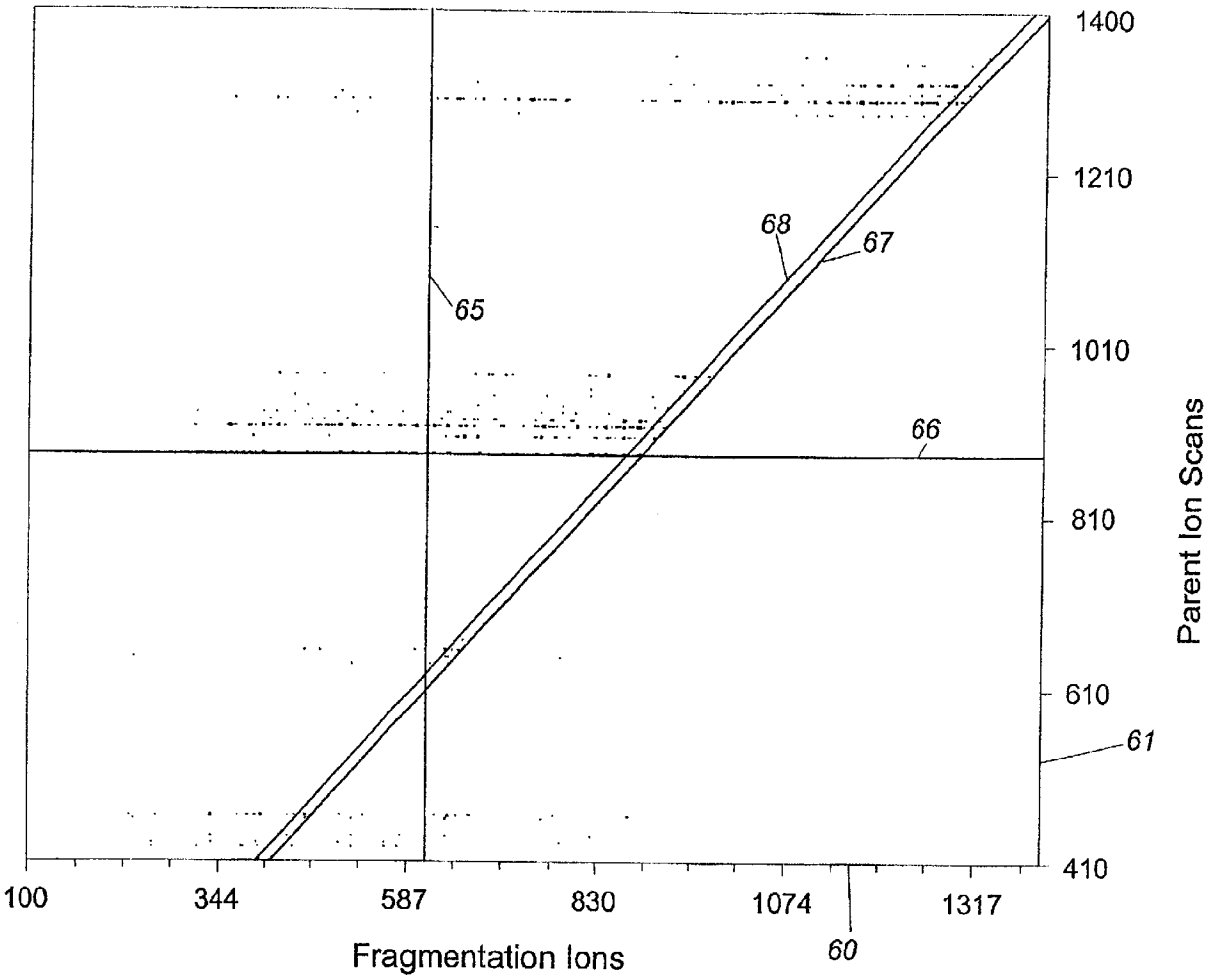
FIG. 5 is a two-dimensional plot of the MS/MS map of FIG. 4, viewed from above, showing the different subsets of MS/MS scans.
Figure 6:
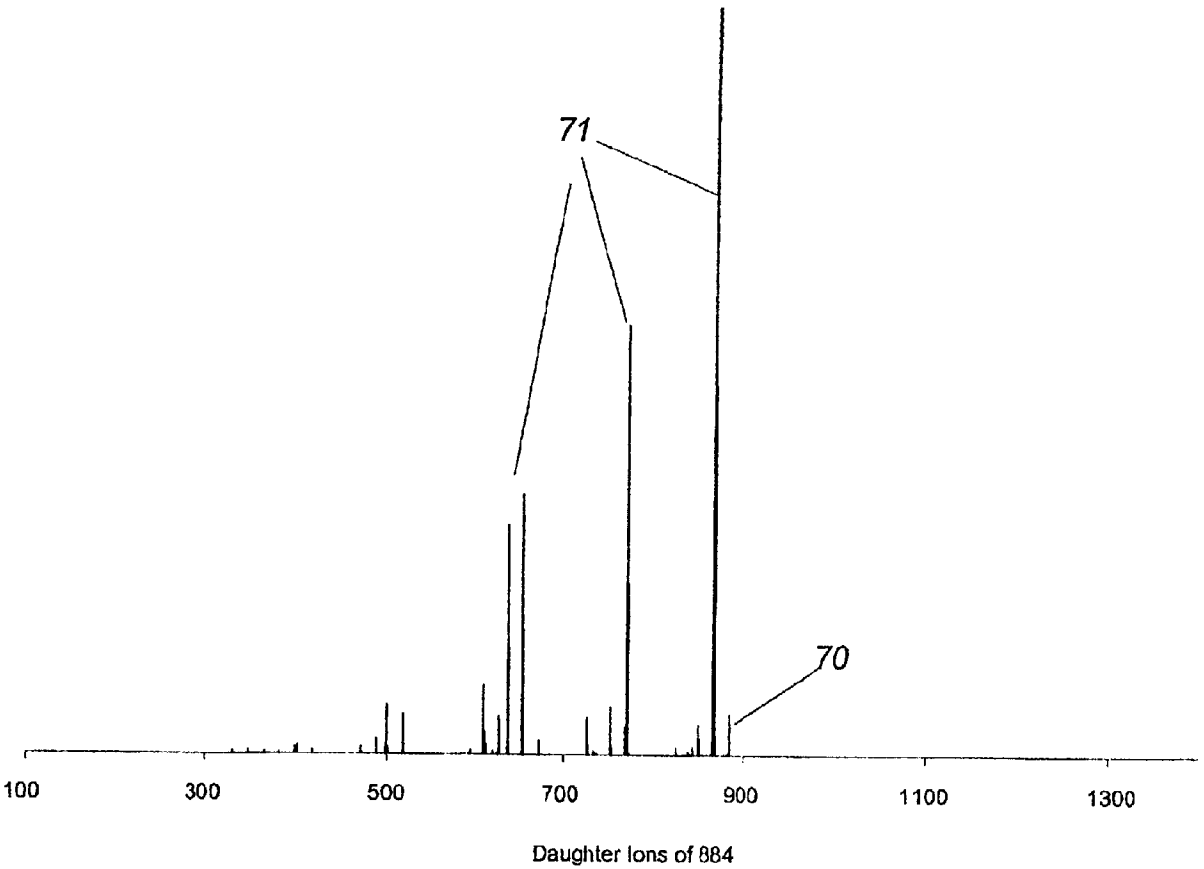
FIG. 6 is a daughter ion scan subset of the MS/MS map of FIG. 5 for a single parent ion (m/z=884) simulating how such a daughter ion scan would appear using the subset two-dimensional MS/MS of this invention.
Figure 7:
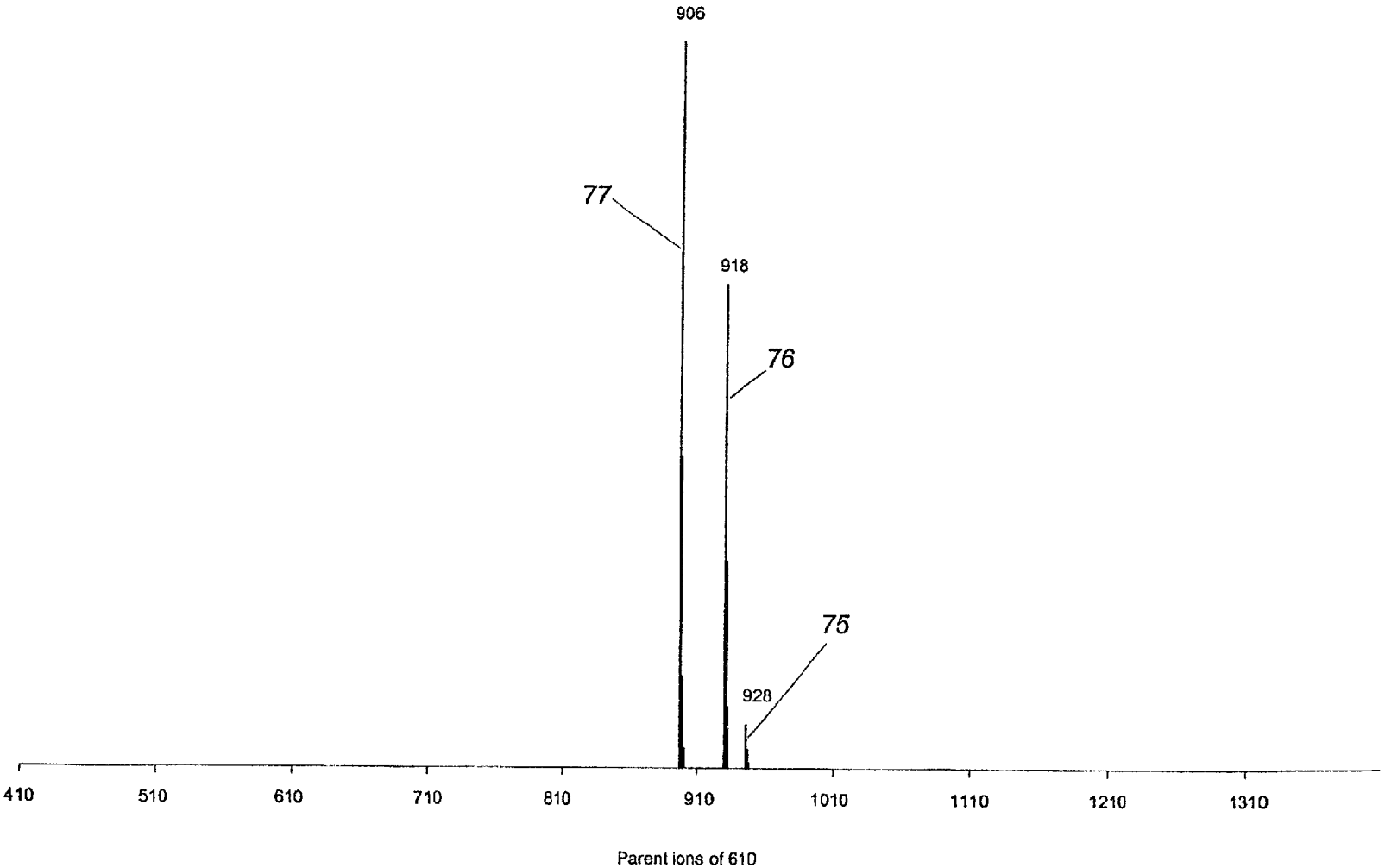
FIG. 7 is a parent ion scan subset of the MS/MS map of FIG. 5 for a single daughter ion (m/z=610) simulating how such a parent ion scan would appear using the two-dimensional MS/MS of this invention.

FIG. 5 is a two-dimensional plot from the same spectrum of data shown in FIG. 4. Once data from this spectrum has been entered into a digital computer it can be viewed in various ways to provide the desired information. For instance, if the data along a horizontal line 66 is plotted alone, as shown in FIG. 6, a daughter scan spectrum for parent ion m/z=884 is provided. If the data along a vertical line 65 (FIG. 5) is plotted alone, as shown in FIG. 7, a parent scan for daughter ion m/z=610 is provided.

Figure 8:
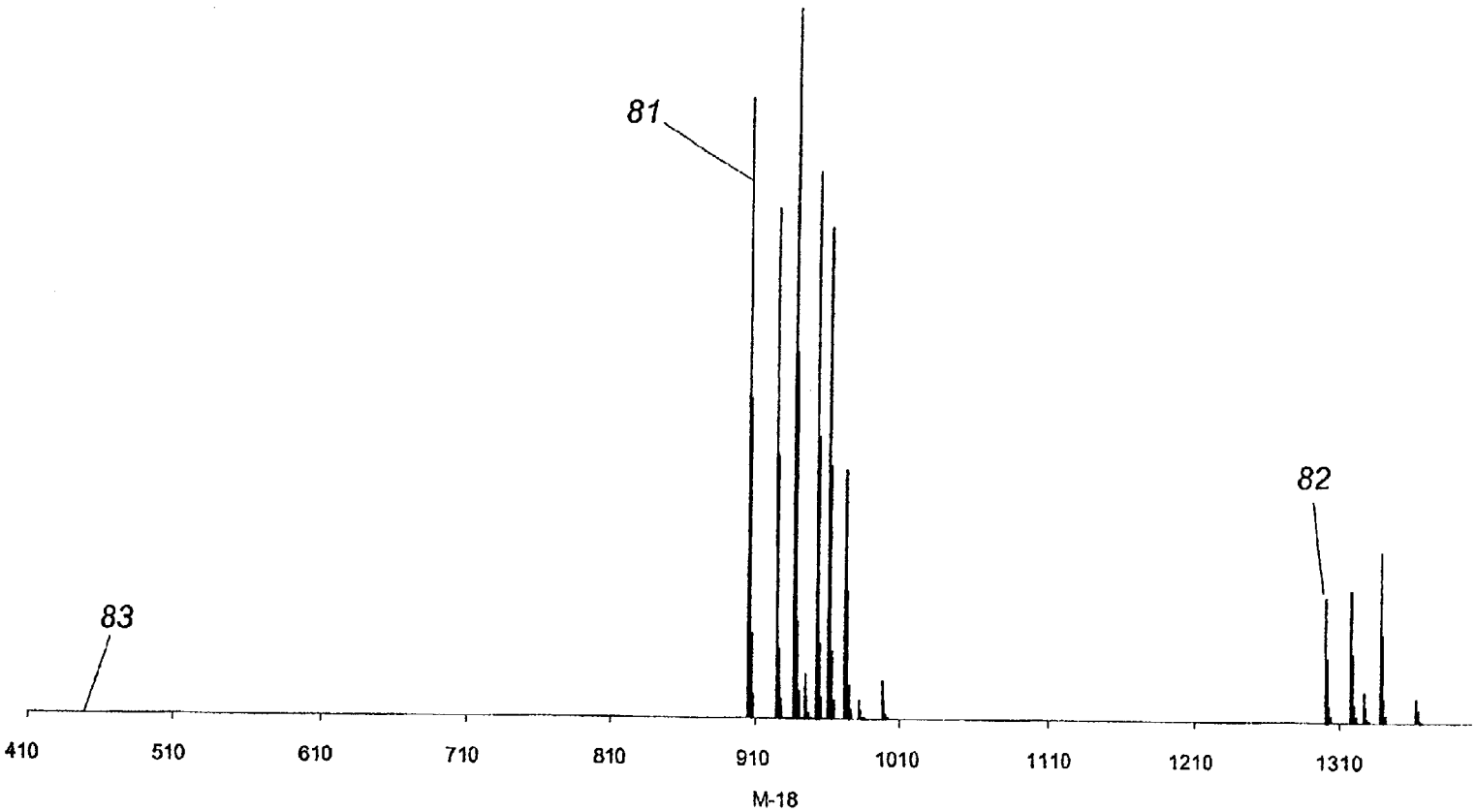
FIG. 8 is a neutral loss scan subset of the MS/MS map of FIG. 5 simulating how such a scan would appear using the two-dimensional MS/MS of this invention.
Figure 10:
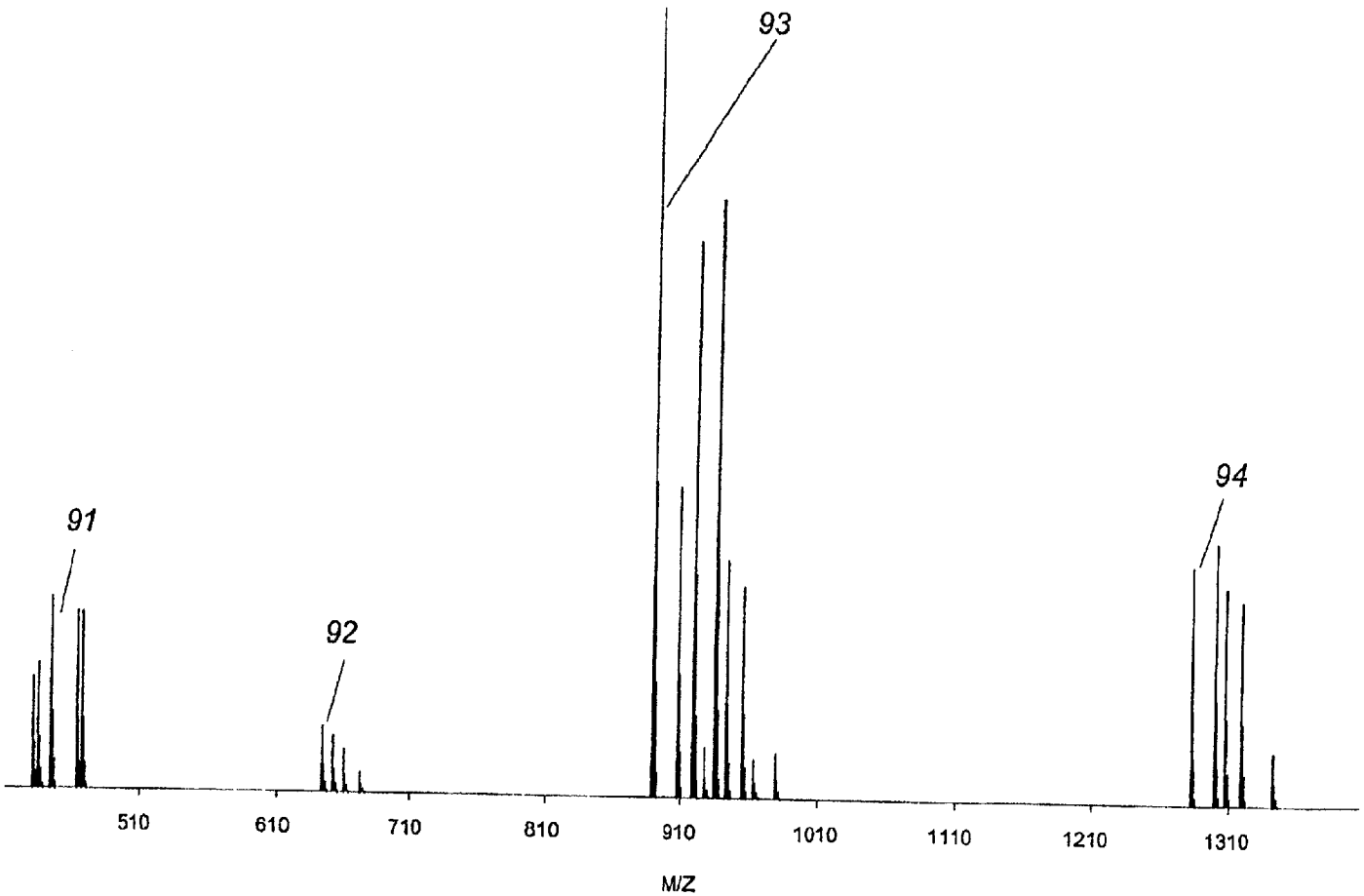
FIG. 10 is a re-constructed full scan first stage MS spectrum of all of the parent ions, simulating how such a scan would appear using the two dimensional MS/MS of this invention.

A diagonal line 67 with the x coordinate equal to the y coordinate represents the data related to unfragmented parent ions. A diagonal line 68 to the left of this first diagonal line 67 where the x coordinate is 18 less than the y coordinate, represents what a neutral loss scan plotted alone would provide, as shown in FIG. 8. If the data for the sum of all x values is plotted on the y-axis, as shown in FIG. 10, a full MS scan of the parent ions is provided.

Figure 9:
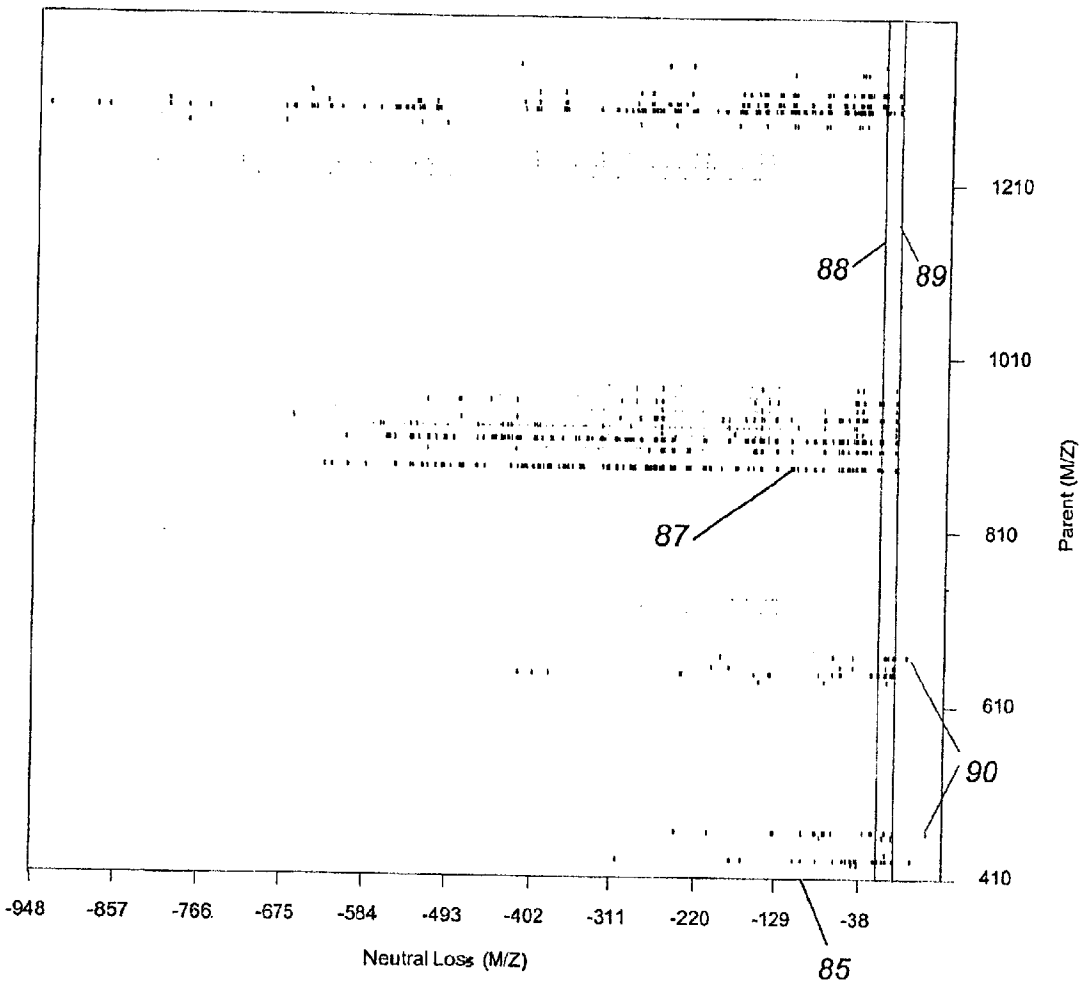
FIG. 9 is a neutral loss two-dimensional map representing the X-axis in terms of amount of neutral loss.

FIG. 9 shows the 2-D neutral loss map from the same spectrum. In this plot, the data points are shifted to the left. The distance of the shifting is equal to the y value. As a result, the new x-axis 85 is transformed to the value of neutral loss. Line 68 in FIG. 5 becomes line 88 in this plot of FIG. 9. Line 67 (FIG. 5) becomes line 89 (FIG. 9). This plot of FIG. 9 gives a clear two-dimensional picture that graphically illustrates the neutral loss relations of each parent ion. Every point lined up vertically (i.e. at 90) represents the same neutral loss.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment. When elements are described as upstream or downstream relative to other elements, the elements can be directly upstream or downstream with no intervening elements or indirectly upstream or downstream with intervening elements therebetween.

What is claimed is:

1. A multiple stage mass spectrometer, comprising in combination: a first non-destructive mass analyzer including an ion trap having an ion inlet downstream from a parent ion source and having an ion outlet; an ion fragmenter downstream from the first mass analyzer said fragmentation cell adapted to divide parent ions from said ion trap outlet into daughter ions, said fragmentation cell including a daughter ion exit; and a second mass analyzer downstream from said ion fragmenter.

2. The mass spectrometer of claim 1 wherein said ion trap includes an inlet coupled to a source of a sample including at least one species of parent ions.

3. The mass spectrometer of claim 2 wherein said ion trap is a three dimensional ion trap.

4. The mass spectrometer of claim 2 wherein said ion trap is a linear ion trap.

5. The mass spectrometer of claim 1 wherein said first mass analyzer includes an outlet for the parent ions contained therein, said outlet aligned with said ion fragmenter.

6. The mass spectrometer of claim 1 wherein said ion fragmenter includes a collision induced dissociation device.

7. The mass spectrometer of claim 1 wherein said fragmenter includes an infrared multi-photon dissociation device.

8. The mass spectrometer of claim 1 wherein said fragmenter includes a collisionally activated dissociation device.

9. The mass spectrometer of claim 1 wherein said ion trap includes an outlet aligned with an entrance into said ion fragmenter.

10. The mass spectrometer of claim 1 wherein said fragmenter includes an exit aligned with said second mass analyzer.

11. The mass spectrometer of claim 1 wherein said second mass analyzer is adapted to separate ions on the order of at least one thousand time faster than separation by said first mass analyzer.

12. The mass spectrometer of claim 11 wherein said second mass analyzer includes a time of flight device.

13. The mass spectrometer of claim 1 wherein a computation device, a memory and a display arc coupled to both said first mass analyzer and said second mass analyzer to receive data from said first mass analyzer and said second mass analyzer associated with ions detected by said first mass analyzer and said second mass analyzer.

14. The mass spectrometer of claim 13 wherein said computation device is adapted to combine data from said first mass analyzer with data from said second mass analyzer to create a two dimensional output plot of mass to charge ratios for at least two parent ions detected by said first mass analyzer and at least two daughter ions detected by said second mass analyzer.

15. The mass spectrometer of claim 1 wherein a source of ions is provided upstream from an inlet into said first mass analyzer, said source of ions including an electrospray upstream from a RF only multi-pole ion guide upstream of an electrostatic lens upstream of an inlet into said first mass analyzer.

16. A tandem mass spectrometer, comprising in combination: a first non-destructive mass analyzer including an ion trap having an ion inlet and a parent ion outlet; a parent ion fragmenter downstream from said first mass analyzer adapted to fragment the parent ions into daughter ions; and a second mass analyzer having a daughter ion input downstream from said parent ion fragmenter.

17. The mass spectrometer of claim 16 wherein said first mass analyzer outlet is selectively openable and closable with said first mass analyzer adapted to release parent ions therefrom when said ion outlet is open and to retain parent ions within said first mass analyzer when said outlet is closed.

18. The mass spectrometer of claim 17 wherein said first mass analyzer includes an ion trap.

19. The mass spectrometer of claim 18 wherein said ion trap is a three dimensional ion trap.

20. The mass spectrometer of claim 18 wherein said ion trap is a linear ion trap.

21. The mass spectrometer of claim 18 wherein said parent ion outlet of said first mass analyzer is adjusted from an open position to a closed position by adjusting a voltage of an electric field of said ion trap.

22. The mass spectrometer of claim 16 wherein both said first mass analyzer and said second mass analyzer are coupled to a means to acquire data related to mass to charge ratios of ions detected by both of said mass analyzers, with said data displayed in two dimensions.

23. The mass spectrometer of claim 22 wherein said means to acquire data includes mean to display said data in two dimensions including an x axis and a y axis with one of said axes representing a mass to charge ratio of parent ions and the other of said axes representing a mass to charge ratio of daughter ions.

24. The mass spectrometer of claim 16 wherein said second mass analyzer includes a time of flight device.

25. The mass spectrometer of claim 24 wherein said first mass analyzer includes an ion trap.

26. The mass spectrometer of claim 16 wherein said fragmentor includes a collision cell.

27. The mass spectrometer of claim 26 wherein said collision cell includes an RF only multi-pole therein and a collision gas therein such that said collision cell is adapted to cause collision induced dissociation.

28. The mass spectrometer of claim 16 wherein said fragmentor includes an infrared laser oriented to expose the parent ions with photons to induce fragmentation of the parent ions into daughter ions.

29. A two stage mass analyzer, comprising in combination:

a first non-destructive mass analyzer in the form of an ion trap; said ion trap having an inlet downstream from a parent ion source and a parent ion outlet;

a fragmentation cell downstream from said ion trap, said fragmentation cell adapted to divide parent ions from said ion trap outlet into daughter ions, said fragmentation cell, including a daughter ion exit; and a second mass analyzer including a time of flight device downstream from said fragmentation cell exit.

30. The two stage mass analyzer of claim 29 wherein a computer is coupled to said first mass analyzer and said second mass analyzer, said computer adapted to acquire mass to charge ratio data for both parent ions from said first mass analyzer and daughter ions from said second mass analyzer.

31. The two stage mass analyzer of claim 30 wherein said computer is adapted to correlate parent ion data with daughter ion data.

32. The two stage mass analyzer of claim 31 wherein said computer is adapted to display correlated parent ion and daughter ion data in the form of a two dimensional plot including an x axis and a y axis with one of said axes representing a mass to charge ratio of the parent ions and the other of said axes representing the mass to charge ratio of the daughter ions.

33. The two stage mass analyzer of claim 29 wherein said fragmentation cell includes a collision induced dissociation device.

34. The two stage mass analyzer of claim 29 wherein said fragmentation cell includes an infrared multi-photon dissociation device.

35. The two stage mass analyzer of claim 29 wherein said fragmentation cell includes a collisionally activated dissociation device.

36. The two stage mass analyzer of claim 29 wherein said ion source upstream of said first mass analyzer is an output of a chromatography device.

37. A multiple stage mass spectrometer, comprising in combination:

a first non-destructive mass analyzer including an ion trap having an ion inlet downstream from a parent ion source and a parent ion outlet;

said first non-destructive mass analyzer adapted to hold at least a portion of parent ions entering said first non-destructive mass analyzer which are not released through said parent ion outlet;

an ion fragmenter downstream from said parent ion outlet; and a second mass analyzer downstream from said ion fragmenter.

38. The apparatus of claim 37 wherein said first non-destructive mass analyzer is adapted to be adjusted to release different parent ions having different mass/charge ratios through said parent ion outlet while holding non-released ions.

39. The apparatus of claim 37 wherein said first non-destructive mass analyzer includes an ion trap.

40. The apparatus of claim 39 wherein said ion trap is a three dimensional ion trap.

41. The apparatus of claim 39 wherein said ion trap is a linear ion trap.

42. The apparatus of claim 39 wherein said second mass analyzer includes a time of flight mass analyzer.

43. The apparatus of claim 42 wherein said time of flight mass analyzer is adapted to separate ions on the order of at least one thousand times faster than separation by first mass analyzer.

* * * * *